US006682469B1

(12) United States Patent
Knoerzer

(10) Patent No.: US 6,682,469 B1
(45) Date of Patent: Jan. 27, 2004

(54) INSIDE PRINTING OF FLEXIBLE PACKAGES

(75) Inventor: Anthony Robert Knoerzer, Plano, TX (US)

(73) Assignee: Recot, Inc., Pleasanton, CA (US)

( * ) Notice: Subject to any disclaimer, the term of this patent is extended or adjusted under 35 U.S.C. 154(b) by 84 days.

(21) Appl. No.: 09/715,225

(22) Filed: Nov. 17, 2000

(51) Int. Cl.[7] ..... B31C 7/00

(52) U.S. Cl. ..... 493/296; 493/269; 493/320; 493/270

(58) Field of Search ..... 493/270, 269, 493/272, 320, 321, 322, 187, 296; 53/451, 551, 416, 550, 554, 411

(56) References Cited

U.S. PATENT DOCUMENTS 1,661,479 A * 3/1928 Josephson
2,153,846 A 4/1939 Russell et al.
3,027,263 A * 3/1962 Wanamaker
3,252,388 A * 5/1966 Schur
3,611,884 A * 10/1971 Hottendorf
4,337,862 A * 7/1982 Suter
4,462,851 A * 7/1984 Colgate
4,526,566 A 7/1985 Briand
4,563,231 A 1/1986 Porrmann et al.
4,668,211 A * 5/1987 Lubotta et al.
4,869,048 A * 9/1989 Boeckmann
4,890,439 A * 1/1990 Smart et al.
5,389,174 A * 2/1995 Hibsch et al.
5,934,044 A * 8/1999 Weder ..... 53/411
5,938,243 A * 8/1999 De Santo
6,131,374 A * 10/2000 Bois ..... 53/451
6,314,706 B1 * 11/2001 Araki et al. ..... 53/451

* cited by examiner

*Primary Examiner*—Eugene Kim
*Assistant Examiner*—Sameh H. Tawfik
(74) *Attorney, Agent, or Firm*—Colin P. Cahoon; Carstens, Yee & Cahoon, L.L.P.

(57) ABSTRACT

A flexible package, and method for manufacturing same, that provides for the presentation of graphics inside the package using existing converter and vertical form and fill packaging machine technology. The invention involves producing a slightly wider film through the converter having a strip along one edge of the graphics side of the film dedicated to use as a graphics flap inside the formed package.

6 Claims, 3 Drawing Sheets

INSIDE PRINTING OF FLEXIBLE PACKAGES

BACKGROUND OF THE INVENTION

1. Technical Field

The present invention relates to inside printing of flexible packages constructed from either a vertical or horizontal form and fill packaging machine, and the method for making same, that provides for a graphics presentation inside the package for promotional or other purposes. The invention allows for use of existing film converter and packaging technology to produce a package that meets present required packaging guidelines with minimal increased costs.

2. Description of Related Art

Vertical form, fill, and seal packaging machines are commonly used in the snack food industry for forming, filling, and sealing bags of chips and other like products. Such packaging machines take a packaging film from a sheet roll and forms the film into a vertical tube around a product delivery cylinder. The vertical tube is vertically sealed along its length to form a back seal. The machine applies a pair of heat-sealing jaws or facings against the tube to form a transverse seal. This transverse seal acts as the top seal on the bag below and the bottom seal on the package being filled and formed above. The product to be packaged, such as potato chips, is dropped through the product delivery cylinder and formed tube and is held within the tube above the bottom transverse seal. After the package has been filled, the film tube is pushed downward to draw out another package length. A transverse seal is formed above the product, thus sealing it within the film tube and forming a package of product. The package below said transverse seal is separated from the rest of the film tube by cutting across the sealed area.

The packaging film used in such process is typically a composite polymer material produced by a film converter. For example, one prior art composite film used for packaging chips and like products is illustrated in FIG. 1*a*, which is a schematic of a cross-section of the film illustrating each individual substantive layer. FIG. 1*a* shows an inside, or product side, layer 16 which typically comprises metalized oriented polypropylene ("OPP") or metalized polyethylene terephtalate ("PET"). This is followed by a laminate layer 14, typically a polyethylene extrusion, and an ink or graphics layer 12. The ink layer 12 is typically used for the presentation of graphics that can be viewed through a transparent outside layer 10, which layer 10 is typically OPP or PET.

The prior art film composition shown in FIG. 1*a* is ideally suited for use on vertical form and fill machines for the packaging of food products. The metalized inside layer 16, which is usually metalized with a thin layer of aluminum, provides excellent barrier properties. The use of OPP or PET for the outside layer 10 and the inside layer 16 further makes it possible to heat seal any surface of the film to any other surface in forming either the transverse seals or back seal of a package.

Typical back seals formed using the film composition shown in FIG. 1*a* are illustrated in FIGS. 2 and 3. FIG. 2 is a schematic of a "lap seal" embodiment of a back seal being formed on a tube of film. FIG. 3 illustrates a "fin seal" embodiment of a back seal being formed on a tube of film.

With reference to FIG. 2, a portion of the inside metalized layer 26 is mated with a portion of the outside layer 20 in the area indicated by the arrows to form a lap seal. The seal in this area is accomplished by applying heat and pressure to the film in such area. The lap seal design shown in FIG. 2 insures that the product to be placed inside the formed package will be protected from the ink layer by the metalized inside layer 26.

The fin seal variation shown in FIG. 3 also provides that the product to be placed in the formed package will be protected from the ink layer by the metalized inside layer 36. Again, the outside layer 30 does not contact any product. In the embodiment shown in FIG. 3, however, the inside layer 36 is folded over and then sealed on itself in the area indicated by the arrows. Again, this seal is accomplished by the application of heat and pressure to the film in the area illustrated.

As noted, a benefit of both the prior art fin seal and lap seal design is the containment of the product in the package by a barrier layer (the metalized inside layer) that keeps ink and solvent levels in the package to a minimum. Ink and solvent levels in fatty food packages are frequently regulated to insure product safety. It may be desirable, however, to provide a graphics capability inside a package. This would allow for promotional information or coupons to be maintained inside the package and only accessible after the consumer has opened the package. For example, a promotional prize campaign could be offered with the prize announcements being maintained inside the package. Likewise, coupons offering product rebate rewards, promotional prize points, or discounts on products could be maintained within the sealed package.

One prior art method used to provide a graphics capability inside the package involves the use of a paper insert dropped with the product into the package during filling. When the consumer opens the package, the paper insert can be removed for viewing and use. This method has several drawbacks, however. The reliability of placing a single paper insert in each bag (by dropping the paper with a weighed amount of product) is a major consideration, particularly in small packages. A capacity issue is raised by the need to rent inserters to be used during the filling process. Foreign matter detectors are also frequently set off by the detection of the paper insert within the bag. The insertion of a piece of paper can raise the solvent level in the package beyond acceptable levels. All of the above greatly adds to the expense of each single package.

Another approach to providing graphics within the bag would involve the application of the graphics directly to the inside metalized layer 16 shown in FIG. 1*a*. The application of such graphics can be accomplished using an inkjet printer. However, this method likewise raises a capacity issue, since present technology converters produce packaging film at a speed of 1500 to 2000 feet per minute, while the capacity of present inkjet printer heads is approximately 300 feet per minute. Additional modification to converters must be made in order to keep the inkjet printing in register with the graphics formed by the ink layer 12. All of the above considerations again add to the cost of the package. In addition, the United States Food & Drug Administration does not presently allow for the use of an ink-carrying layer that comes into contact with a fatty food.

Another prior art approach to this issue is illustrated in FIG. 1*b*, which is again a schematic cross-section of a packaging film. As with the embodiment shown in FIG. 1*a*, the embodiment shown in FIG. 1*b* comprises an outside OPP layer 10 followed by an ink layer 12, a laminate layer 14, and a metalized OPP or PET layer 16. However, an additional laminate layer 14' is applied to the metalized layer 16 so that an additional ink layer 12' and OPP or PET layer 10' can be used as the new inside layer 10'. The use of the ink layers 12, 12' as the second to last layer on both the outside and inside of the package allows for a full graphics capability on both the outside and the inside of the film. The additional film, however, adds approximately sixty percent (60%) to the cost of the material when compared with the embodiment shown in FIG. 1*a*. Overall capacity is also cut in half, since the film must be run through a typical converter twice. Further, since the material is 60% thicker, it cannot be run on a vertical form and fill machine at speeds as high as that used to make packages out of the embodiment shown in FIG. 1*a*. This is because longer dwell times must be used to form all the seals involved. As with the inkjet printer solution, the embodiment shown in FIG. 2*a* also requires additional efforts to keep the inside graphics and outside graphics in registration. Importantly, the embodiment shown in FIG. 1*b* again places ink inside a functional barrier layer, the metalized layer 16, which is not presently permitted for direct contact with many foods by the United States Food & Drug Administration.

Consequently, a need exists for a package construction method and resultant package that allows for graphics that are available on the inside of a package upon opening of the package by the consumer that can be adapted to existing converter and form and fill packaging machines without reducing the capacity of either. Further, such invention should allow for easy registration of the inside to outside graphics and, preferably, would not place an ink layer inside a functional barrier layer, or at least minimize the exposure of an ink layer to the product.

SUMMARY OF THE INVENTION

The proposed invention involves producing a slightly wider film through the converter (or alternatively allocating an end portion of film and creating a narrow, taller package) having a strip along one edge of the graphics side of the film dedicated to use as a graphics flap inside the formed package. The invention then involves, in one embodiment, forming a lap seal leaving this graphics strip as a flap inside the bag to allow for flipping the flap over for exposure of the graphics located thereon.

The method uses existing converter and form and fill machine technology without affecting the capacity of either. Further, the use of a graphics flap adds little to the cost of each bag.

The above as well as additional features and advantages of the present invention will become apparent in the following written detailed description.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1A:
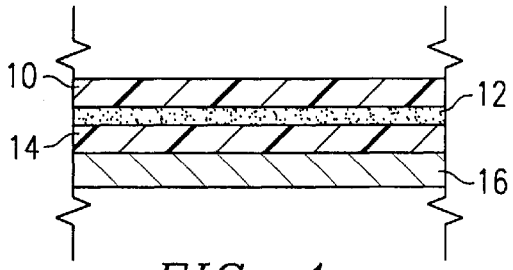
FIG. 1a (PRIOR ART)
FIGS. 1*a* and 1*b* are schematic cross-section views of prior art packaging films.
Figure 4:
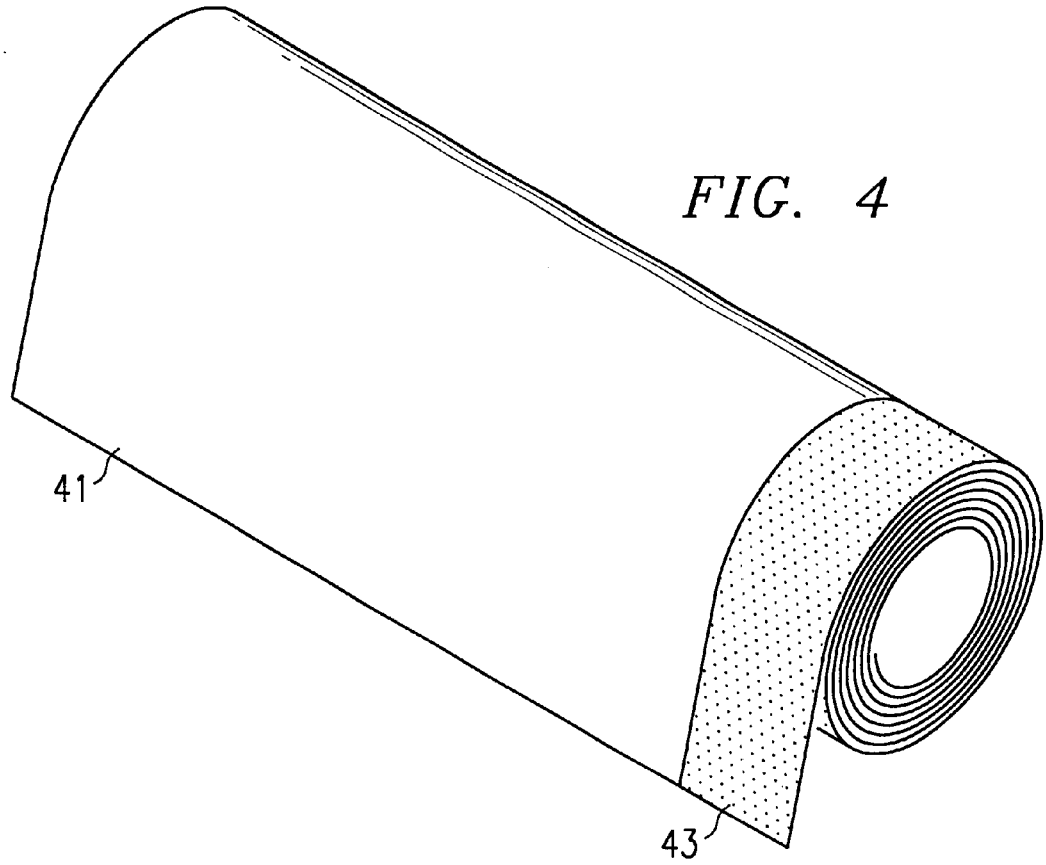
FIG. 4 is a perspective view in elevation of a sheet of film used with the present invention.

FIG. 4 shows a roll of packaging film used by the invention and formed by a prior art converter. The composition of the film can be the same as used for prior art packaging as described in relation to FIG. 1*a* or any other prior art film composition used for the product application in question. However, with reference to FIG. 4, the ink layer comprises both an outside graphics panel 41 and an inside graphics panel 43. The graphics panel 43 can be placed at either end of the packaging film roll. The width of the outside graphics panel 41 is determined by the width of the resultant bag and typically approximates the width of film used in prior art package formation methods for a like-size resultant package. Alternatively, the same total film width can be used, thereby producing a narrower resultant package, as will be understood from the description that follows. The width of the inside graphics panel 43 is dependent of the width of the resultant bag and the desired interior graphics presentation. For example, a 1-oz. package with a bag width of 11-½ inches might require an inside graphics panel 43 width of between ½-inch and 2-½ inches. The inside graphics panel 43, therefore, necessitates a wider overall film width over prior art methods for the same resultant package width. For most flexible bag applications, the inside graphics panel 43 will increase the overall film width on the order of 4% to 25%. However, this added width is the only physical difference required between the film used on prior art packages and the present invention.

The graphics of the outside graphics panel 41 and the inside graphics panel 43 are easily kept in registration, because both graphics panels 41, 43 are applied at the same step, on the same layer, and oriented to the same perspective view during film formation through the converter. This is a distinct advantage over films formed by running a film composition through a converter twice, with graphics on both sides of the film that must be kept in registration over a film length of up to 150,000 feet.

Figure 5A:
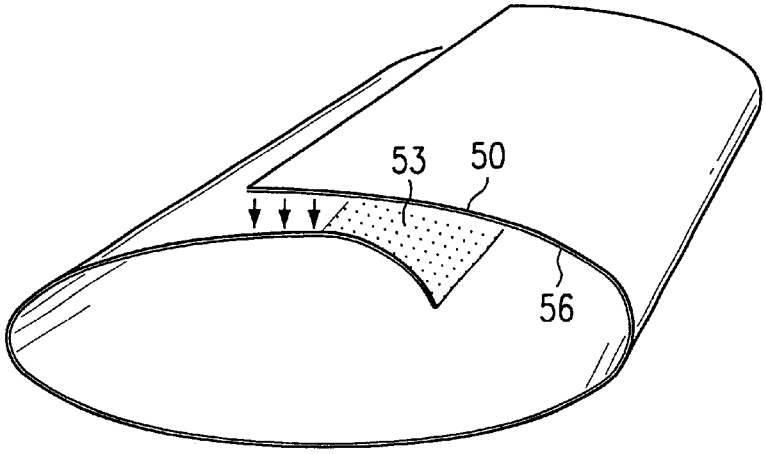
FIG. 5*a* is a schematic cross-section of a tube of packaging film formed by the present invention methods.
Figure 5B:
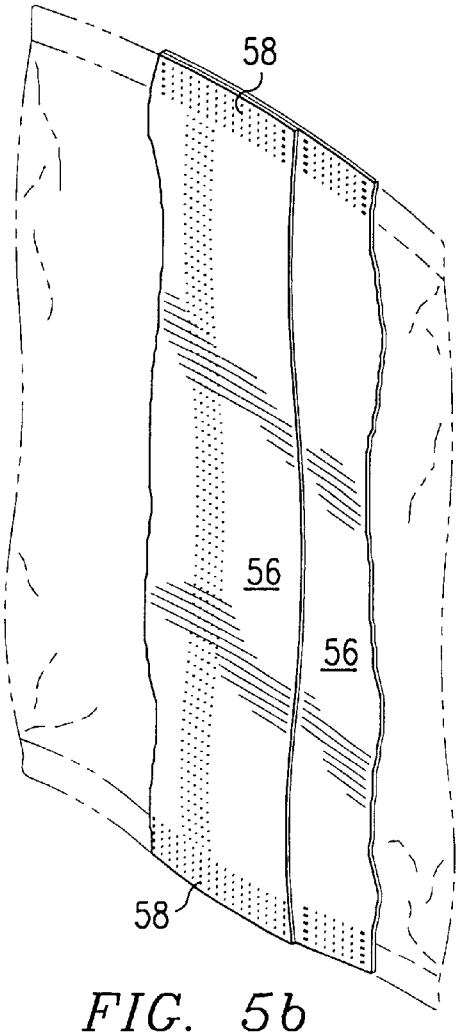
FIGS. 5*b* and 5*c* are perspective views of one inside wall of a resultant package formed by the film tube of FIG. 5*a* with the back seal area emphasized.
Figure 5C:
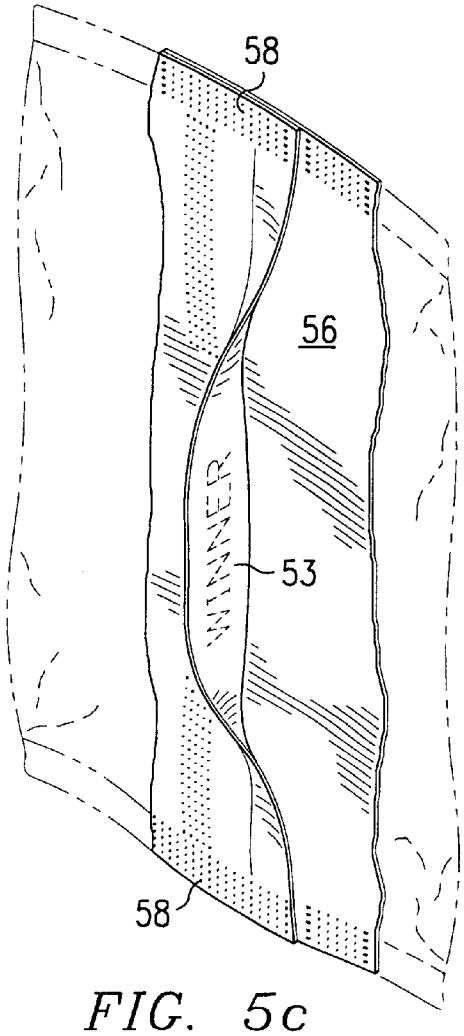

The film used in the present invention is fed into a prior art vertical or horizontal form, fill, and seal packaging machine, as previously described. FIG. 5*a* illustrates the formation of a film tube of the preferred embodiment of the invention. As with a prior art lap seal, the outside layer of the film 50 (displaying the outside graphics panel 41 of FIG. 4) is mated with the inside layer of the film 56 in the area illustrated by the arrows in order to form a back seal. However, a flap 53 protrudes into the interior of the tube and is not sealed against the inside layer 56 along the back seal. This flap 53 comprises the inside graphics panel shown in FIG. 4. This provides for the presentation of graphics within a package ultimately formed of this tube of film when the consumer folds back the flap 53 to reveal the graphics printed thereon, as is shown in FIG. 5*c*, which illustrates one inside wall of a resultant package highlighting the area around the back seal. The package formed by the tube illustrated in FIG. 5*a*, however, maintains a barrier layer, the metalized inside layer 56, between the product contained therein and the graphics or ink layer, as is shown in FIG. 5*b*, which also shows on inside wall of a resultant package. This is because the flap 53 will tend to lie flat against the inside layer 56 within the body of the package when transverse seals 58 are formed on each end of the package. Within each transverse seal 58, an edge of the flap 53 is sealed against the inside layer 56, thus holding the flap 53 flush against the inside layer 56 along the length of the package parallel to the back seal.

Figure 6:
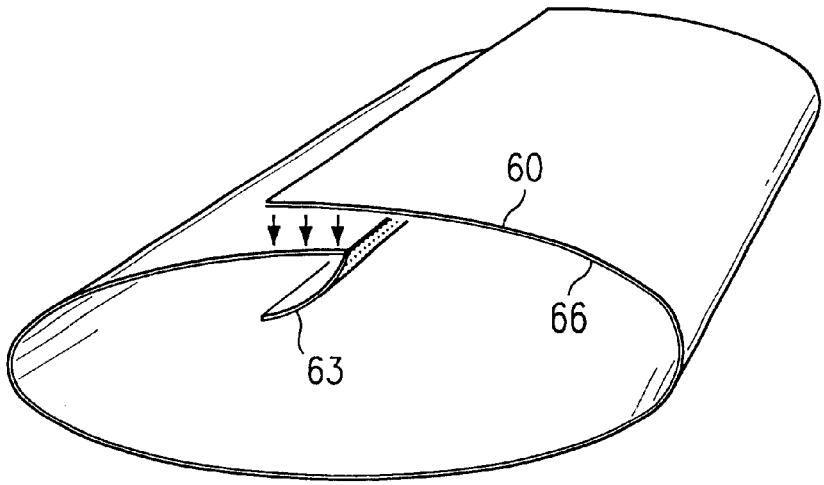
FIG. 6 is a schematic cross-section of an alternative embodiment of a tube of packaging film formed by the present invention methods.

Another embodiment of the present invention is shown in FIG. 6. Again, the inside layer 66 and outside layer 60 are mated, as in a prior art lap seal, in the area shown by the arrows. A flap 63, again comprising the inside graphics panel, is folded over such that the inside graphics panel faces the interior of the tube and, ultimately, the interior of the resultant package. The folded over flap 63 is held flush against the back seal when the transverse seals for a resultant package are formed, since an edge of the flap 63 is sealed against the inside layer 66 within each transverse seal. Alternatively, the flap 63 can be tacked flush against the back seal when the back seal is formed.

Figure 1B:
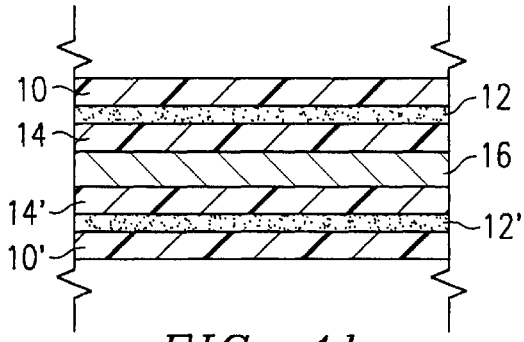
FIG. 1b (PRIOR ART)
Figure 2:
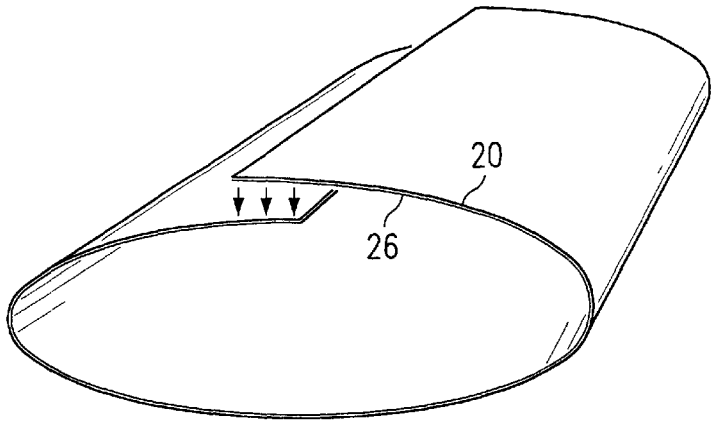
FIG. 2 (PRIOR ART)
FIG. 2 is a schematic cross-section view of a tube of packaging film illustrating the formation of a prior art lap seal.
Figure 3:
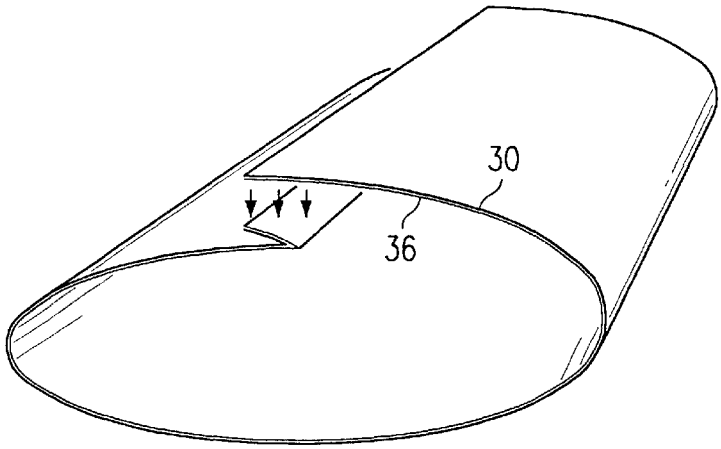
FIG. 3 (PRIOR ART)
FIG. 3 is a schematic cross-section of a tube of packaging film illustrating the formation of a prior art fin seal.

This embodiment, with the flap 63 folded over against the back seal, provides for immediate viewing of the presentation of graphics inside the resultant package along the back seal of the package. Unlike the embodiment illustrated in FIG. 5*a*, however, the resultant package formed from the tube illustrated in FIG. 6 does allow for a minimal strip of the graphics panel (along the flap 63) to come into contact directly with the product contained inside the resultant package. This is only permissible if the solvent levels introduced by such construction are acceptable for the given application. The package formed by the tube illustrated in FIG. 6 is superior to the prior art packages formed by the film illustrated in FIG. 1*b* in this regard, however, since the exposure of the graphics layer inside the package is minimized to the surface area of the thin flap 63.

Advantages of forming packages using the embodiments illustrated in either FIG. 5*a* or FIG. 6 over any prior art solution include the ability to use existing converter and form and fill packaging machines with little modification and with no loss in packaging capacity or throughput, and minimal increases in overall packaging costs. Capacity of the converter and the form and fill packaging machines are not affected at all, since the film used by the present invention is formed in one pass through the converter and, in physical structure, is the same as prior art films. No increase in dwell times is required in forming the seals involved and no other capacity issues are raised through the introduction of a foreign object or the need for special ink jet printers. The increased cost is minimal, since the invention only requires a slightly wider roll of film produced by the converter or the same size film producing a slightly narrower package.

While the invention has been particularly shown and described with reference to a preferred embodiment, it will be understood by those skilled in the art that various changes in form and detail may be made therein without departing from the spirit and scope of the invention.

What is claimed is:

1. A method for forming an enclosed, flexible food product package using a vertical form, fill and seal machine comprising the steps of:

a) providing a flexible film having a first side and a second side, wherein a first graphics panel and a second graphics panel are both applied on the first side of said flexible film, and said second graphics panel is located at one end of said flexible film;

b) feeding said flexible film into a vertical form, fill and seal machine;

c) mating a portion of said second side at one end of said film with a portion of said first side near an opposing end of said film, thereby forming a vertical tube with a back seal along the length of said vertical tube and an inner graphics flap attached to said back seal at one vertical end, wherein said inner graphics flap comprises said second graphics panel, and said second graphics panel is overlapped by but not attached to the second side of said film; and d) forming an upper transverse seal and a lower transverse seal on said vertical tube, thereby forming an enclosed, flexible food product package.

2. The method of claim 1 further comprising the step of holding said inner graphics flap flush against the second side of said film with said upper transverse seal and said lower transverse seal.

3. The method of claim 1 further comprising the step of folding said inner graphics flap back against said back seal such that said second graphics panel faces an interior space enclosed within said food product package.

4. The method of claim 1 wherein the flexible film of step a) further comprises a laminate layer between said first side and said second side.

5. The method of claim 1 wherein the flexible film of step a) further comprises an outer transparent polymer layer.

6. An enclosed, flexible food product package formed by the method of claim 1.

* * * * *